United States Patent [19]

Grave

[11] Patent Number: 4,654,925

[45] Date of Patent: Apr. 7, 1987

[54] NOZZLE STRUCTURE FOR A SURFACE COVERING CLEANING MACHINE

[76] Inventor: Dale L. Grave, 125 Queensland La. North, Plymouth, Minn. 55447

[21] Appl. No.: 856,346

[22] Filed: Apr. 28, 1986

[51] Int. Cl.[4] ..... A47L 11/30

[52] U.S. Cl. ..... 15/322; 15/421

[58] Field of Search ..... 15/321, 322, 421

[56] References Cited

U.S. PATENT DOCUMENTS

| | | | |
|---|---|---|---|
| 742,880 | 11/1903 | Lotz . | |
| 1,060,191 | 4/1913 | Kent | 15/421 |
| 3,186,132 | 9/1963 | Duncan | 51/11 |
| 3,619,849 | 11/1971 | Jones | 15/321 |
| 3,654,662 | 4/1972 | Bates | 15/302 |
| 3,663,984 | 5/1972 | Anthony | 15/321 |
| 3,705,437 | 12/1972 | Rukavina et al. | 15/322 X |
| 3,747,155 | 7/1973 | Koellisch | 15/322 |
| 3,774,262 | 11/1973 | Anthony | 15/321 |
| 3,775,053 | 11/1973 | Wisdom | 8/142 |
| 3,840,935 | 10/1974 | Fitzgerald et al. | 15/322 |
| 3,866,264 | 2/1975 | Engquist | 15/421 |
| 3,919,729 | 11/1975 | Cannan | 8/158 |
| 4,091,496 | 5/1978 | Desrosters et al. | 15/421 X |
| 4,194,262 | 3/1980 | Finley | 15/314 |
| 4,263,693 | 4/1981 | Mekelburg | 15/345 |
| 4,335,486 | 6/1982 | Kochte | 15/322 X |
| 4,488,330 | 12/1984 | Grave | 15/322 |
| 4,584,736 | 4/1986 | Gremminger | 15/322 |

*Primary Examiner*—Chris K. Moore

*Attorney, Agent, or Firm*—Leo Gregory

[57] ABSTRACT

A cleaning head for a surface covering material cleaning machine made up as a fairly wide nozzle having a plurality of jets mounted therein delivering a pressurized air entrained cleaning fluid, and utilizing an additional air stream engaging and co-mixing with the fluid diverting it into an angle as it engages the surface to be cleaned; the additional air stream taken with the pressurized cleaning fluid provides a partial support for the cleaning head whereby the cleaning head glides over the underlying surface, and self adjusting end plates seal the end walls of the cleaning head.

9 Claims, 14 Drawing Figures

FIG. 1
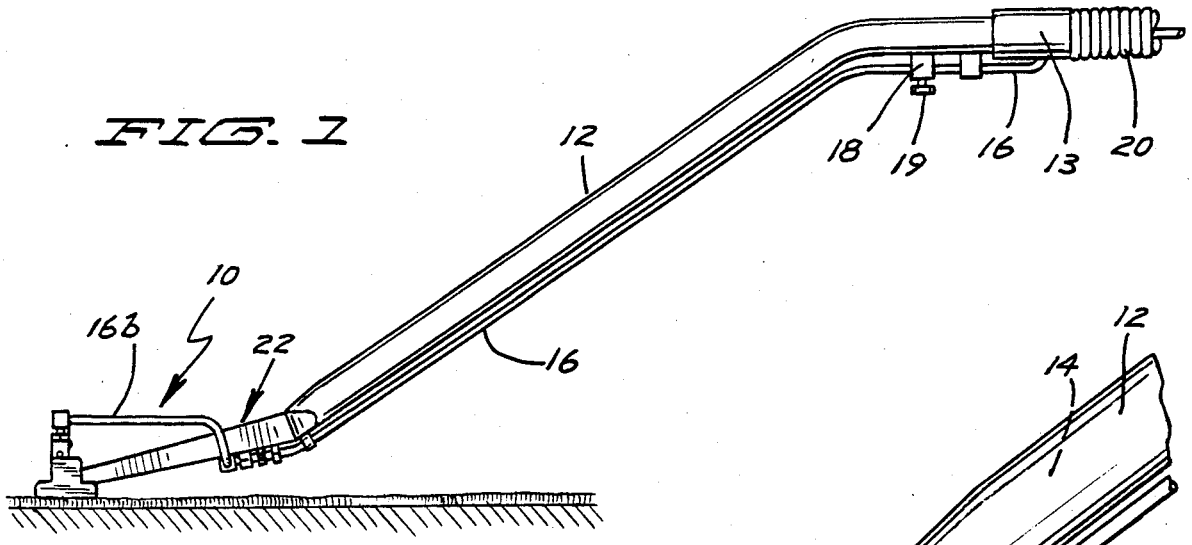
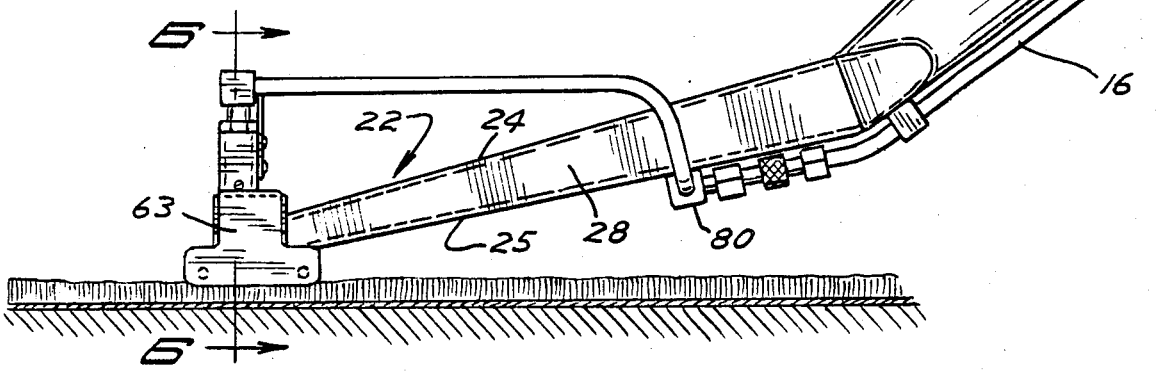
FIG. 2
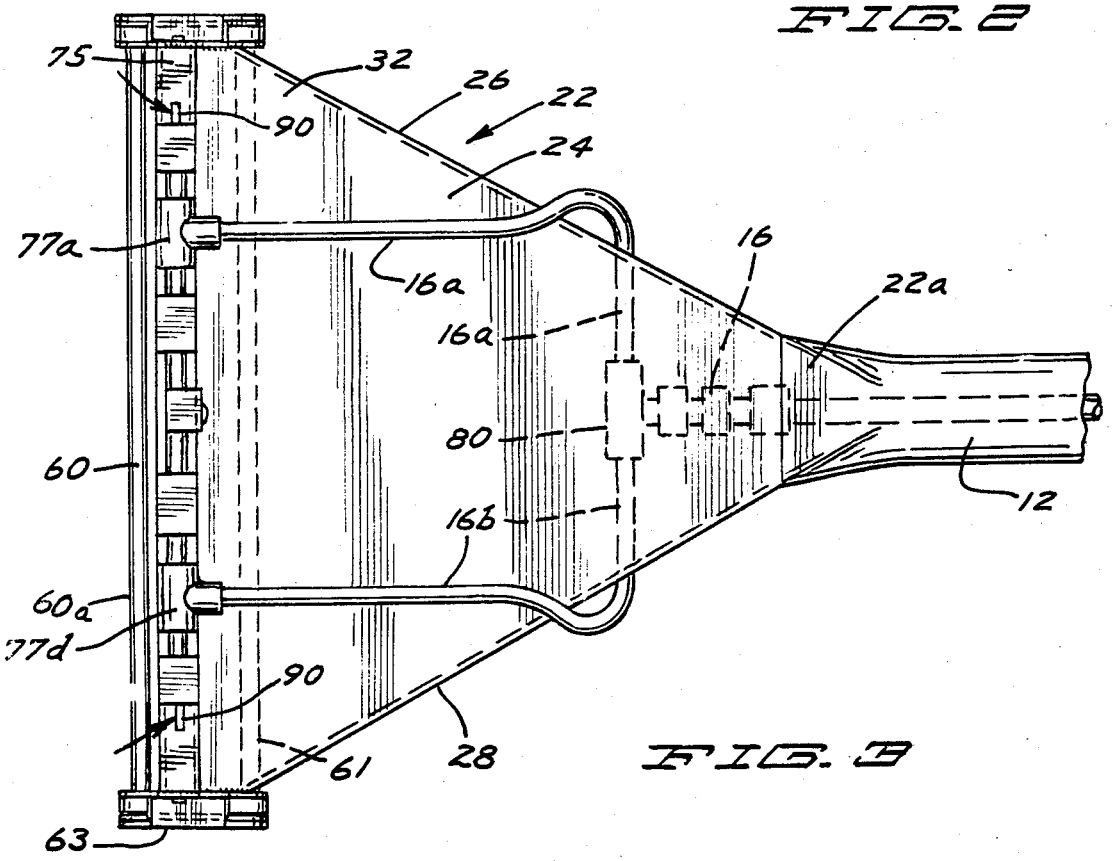
FIG. 3

FIG. 4
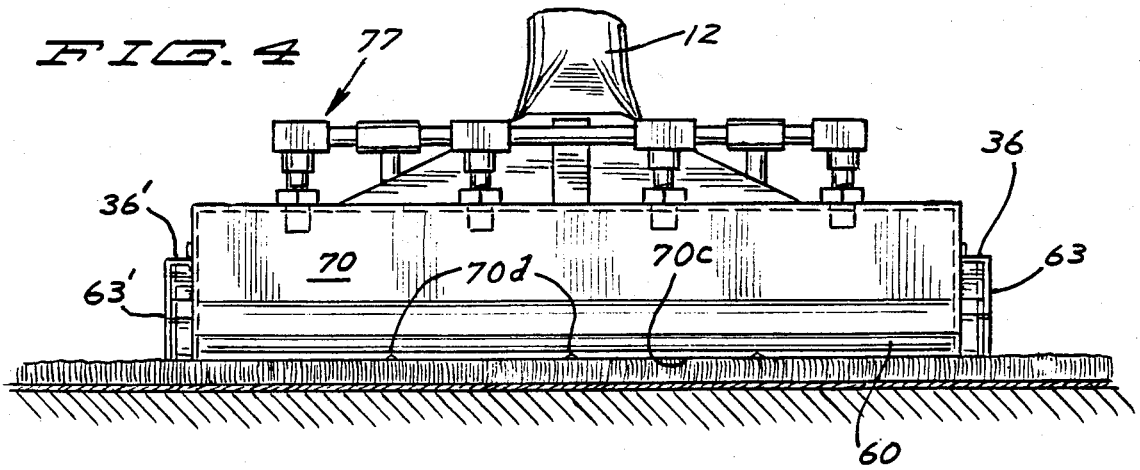
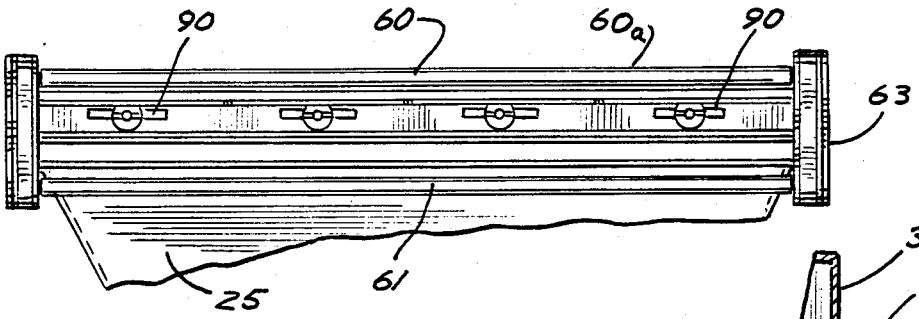
FIG. 5
FIG. 6A
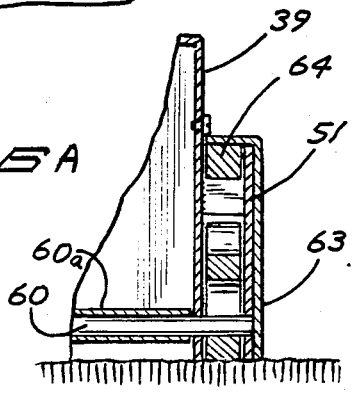
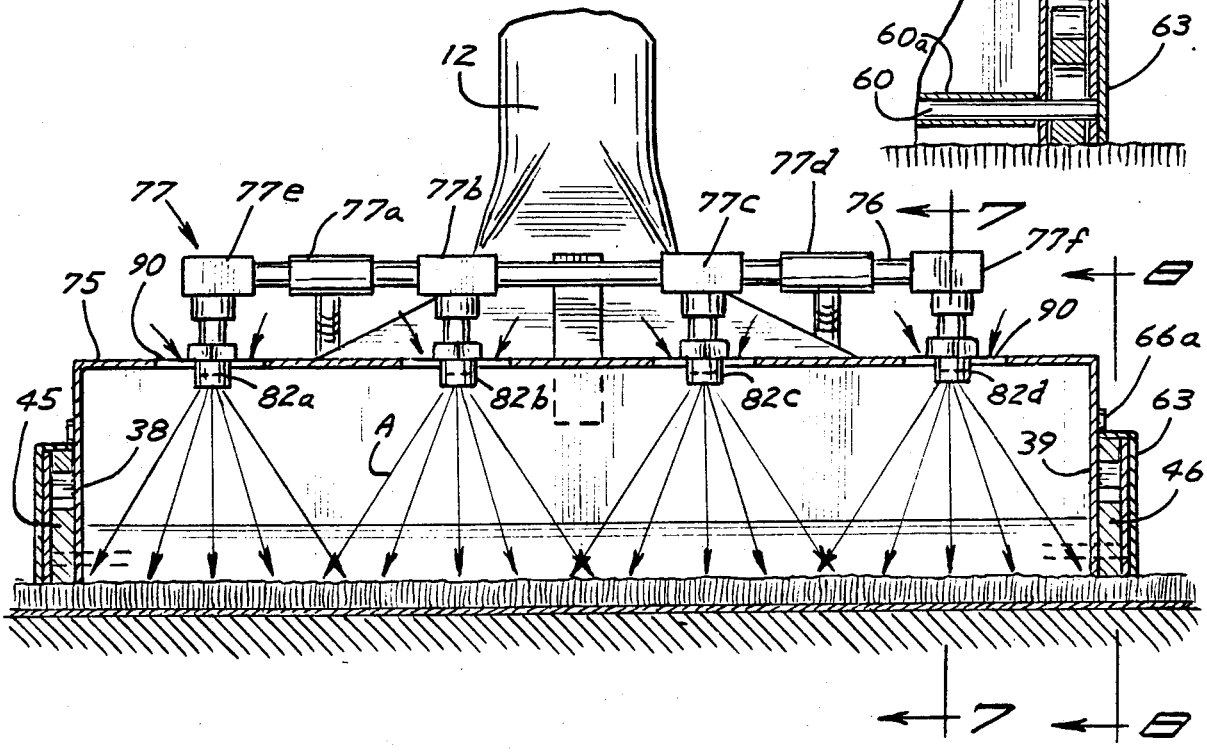
FIG. 6

NOZZLE STRUCTURE FOR A SURFACE COVERING CLEANING MACHINE

BACKGROUND OF THE INVENTION

1. Field of the Invention

This invention relates to a cleaning head structure for a surface material cleaning machine.

2. Description of the Prior Art

It is the usual practice in the art to apply a stream of cleaning fluid directly onto a surface being cleaned with sufficient force to break free and loosen the soil embedded therein. The result often is an undesirable puddling and saturating effect.

In Hayes U.S. Pat. No. 3,262,146 there is disclosed a two chamber nozzle structure which applies a highly pressurized vapor which becomes a condensate upon engaging the surface and a puddling effect occurs prior to its withdrawal.

The applicant in his U.S. Pat. No. 4,488,330 provides improvement in co-mingling an air stream with a cleaning fluid to engage at an angle the nap or pile of the material to be cleaned and the same is withdrawn leaving a minimum residue of dampness.

Further in applicant's structure of his U.S. patent application Ser. No. 789,117, he discloses a tapered cleaning housing which causes a very effective convergence of cleaning fluid and air upon the surface being cleaned and in a continuous motion by suction applied, the cleaning fluid is drawn across and/or through the surface material to be cleaned, as the case may be, and is then effectively withdrawn to a receiving chamber.

SUMMARY OF THE INVENTION

The nozzle or cleaning head structure of this invention represents improvement over prior art in providing a more effective co-mixture of air and cleaning fluid.

It is an object of this invention in connection with a nozzle structure to comprise an arrangement of one or more jets for a very effective co-mixture of air and cleaning fluid to cause the cleaning fluid to become reduced to very small particles for an effective penetration of the surface material to be cleaned and further an air stream is drawn into said nozzle to engage the leading edge of the stream of cleaning fluid as it moves into engagement with said surface.

With reference to the previous object, as said air stream is drawn into engagement with said stream of cleaning fluid, said air stream has such force as to cause a deflection of said stream of cleaning fluid such as to engage the surface to be cleaned at an angle to be in effect swept into and through the material to be cleaned in a continuous moving action which leaves very little residue of dampness in the cleaned area.

It is also an object of this invention to provide means supporting the nozzle structure which very effectively aligns and smooths out the nap or pile of the cleaned surface.

It is another object of this invention to have a floating shoe at each end of the nozzle structure to adjust to an uneven surface to maintain a seal at the ends of said nozzle for a more effective suction action within the housing of the nozzle.

It is also an object of this invention to provide within the housing of the nozzle structure a well defined cleaning chamber confining the jet streams of cleaning fluid.

It is a further object of this invention to provide confluent air and fluid streams to form a sufficient cushion to cause the cleaning head to glide over the underlying surface and thereby reduces substantially frictional and suction resistance.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a view in side elevation;

FIG. 2 is a fragmentary view in side elevation;

FIG. 3 is a fragmentary top plan view showing some parts in dotted line;

FIG. 4 is a fragmentary view in front elevation with a portion broken away;

FIG. 5 is a fragmentary bottom plan view;

FIG. 6 is a view in transverse section taken on line 6—6 of FIG. 2 as indicated;

FIG. 6A is a fragmentary view of a detail on an enlarged scale;

DESCRIPTION OF A PREFERRED EMBODIMENT

Figure 7:
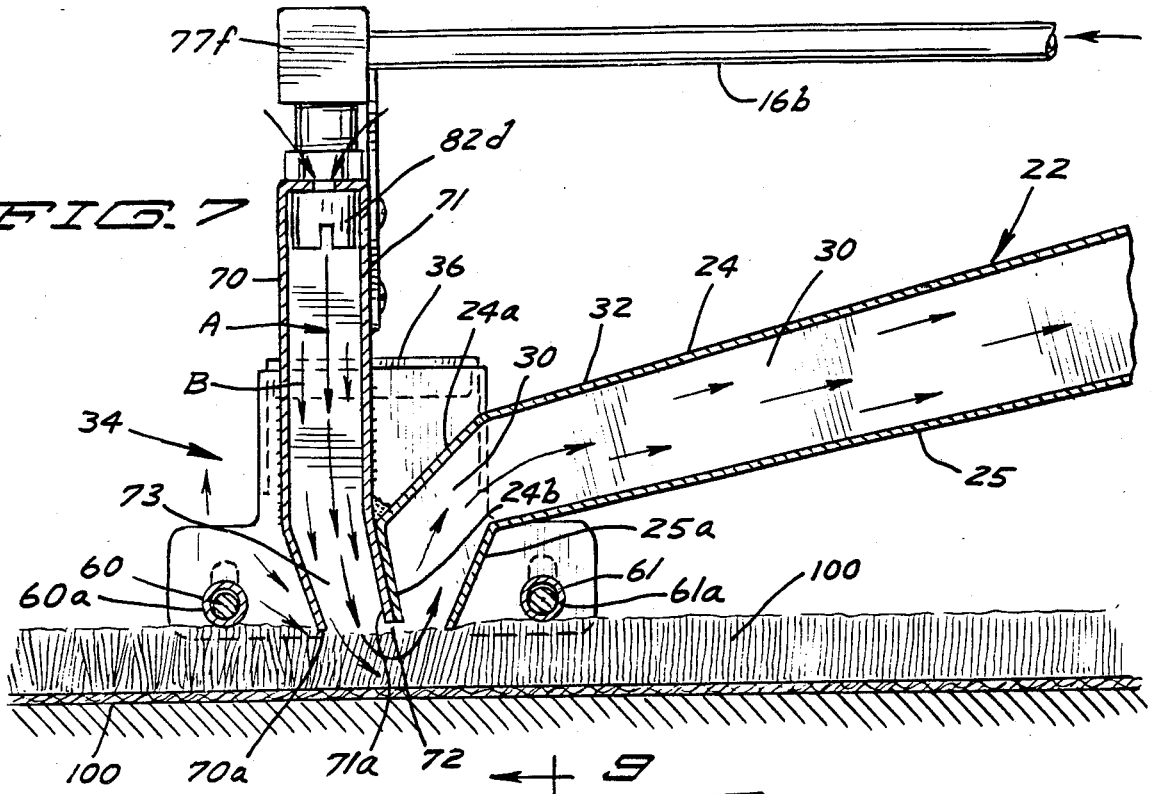
FIG. 7 is a broken view in longitudinal vertical section taken on line 7—7 of FIG. 6 as indicated.
Figure 8:
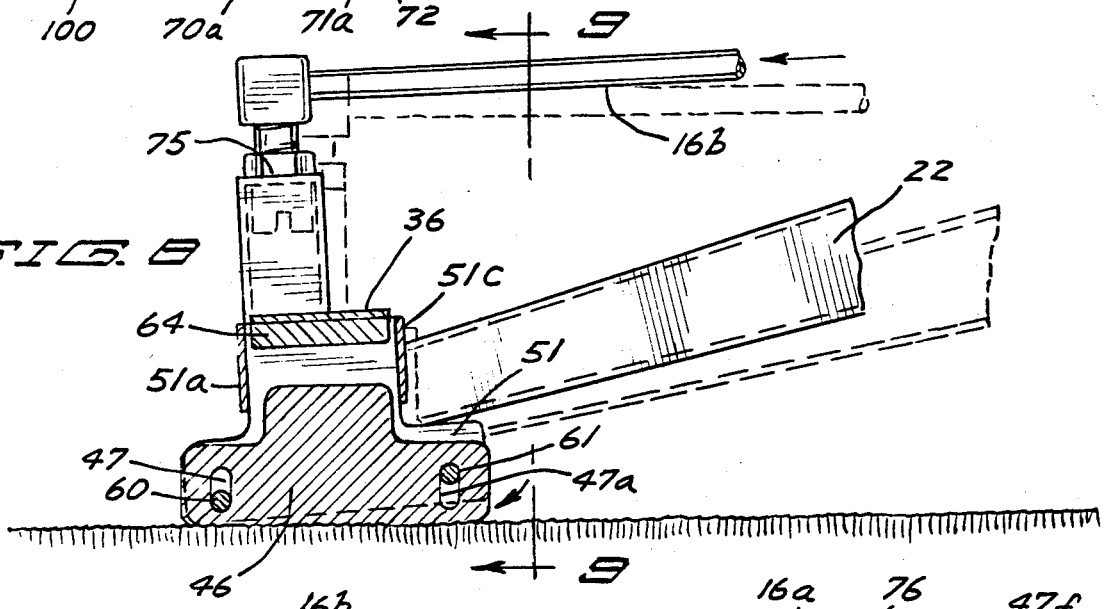
FIG. 8 is a view similar to FIG. 7 showing an alternate position in dotted line taken on line 8—8 of FIG. 6 as indicated.
Figure 9:
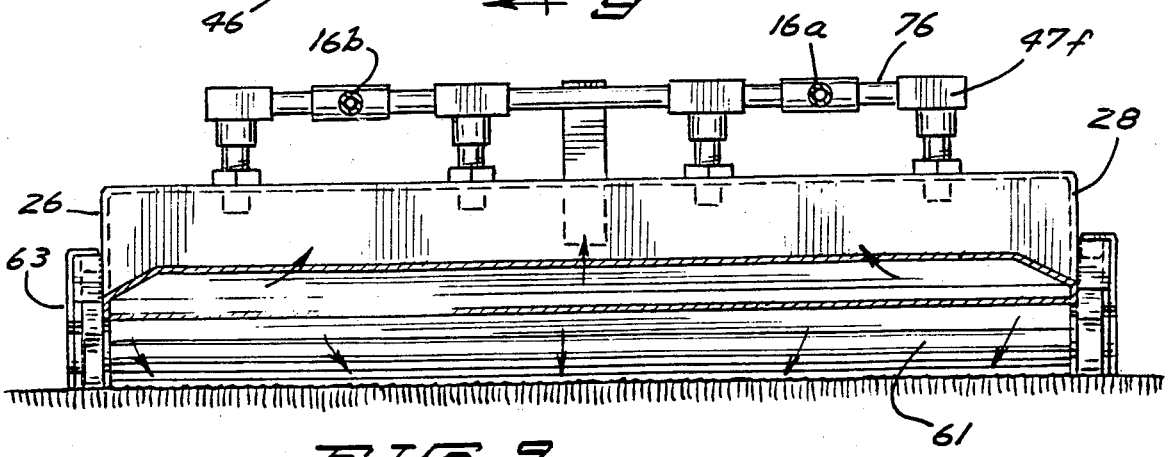
FIG. 9 is a view in vertical cross section taken on line 9—9 of FIG. 8 as indicated.

Referring to the drawings, the portion of a cleaning apparatus forming the cleaning head structure thereof is herein shown and is indicated generally by the reference numeral 10. In connection with said head structure and extending upwardly therefrom is a tubular member 12 which serves as a suction pipe and which at its upper portion forms a handle 13. Carried by said member 12 is a fluid line 16 having a valve member 18 and a valve shut off 19. Said line will be further described.

Extending from said handle 13 is a flexible line or conduit 20 which forms an extension of said member 12 and which extends to the remainder of the cleaning apparatus and fluid tank not here shown.

Said cleaning head comprises a transversely substantially V-shaped housing 22 in top plan, in the embodiment here shown. Said housing has a top wall 24, a bottom wall 25, and side walls 26 and 28, said side walls being shown tapering forwardly.

The apex **22*a* of said housing is connected with said tubular member 12 to have free communication between the passage or chamber 30 within said housing and the passage 14** through said tubular member.

The passage 30 through the passage 22 runs to a reservoir tank carried by the main body of the apparatus, not here shown, and acting upon said reservoir is a suction pump which withdraws cleaning fluid through said passages as will be further described. A disclosure of the suction process and of the main body of the apparatus is shown in applicant's U.S. Pat. No. 4,488,330.

At the forward portion of said housing 22, the upper side wall 24 thereof angles forwardly at 24*a* and then downwardly at 24*b*. The bottom wall 25 relative to wall portions 24*a* and 24*b* has an opposed downwardly angled portion 25*a*.

Coextensive with the forward end portion of said housing 22 is vertically disposed housing 34 comprising a pair of spaced front and rear walls 70 and 71 forming therebetween a passage 73, said walls converge somewhat at the bottom thereof, both being angled rearwardly as at 70*a* and 71*a*. Said lower angled wall portions 71*a* and 24*b* and adjoining and are secured as by welding and the same terminate above the plane of the bottom of said walls 71 providing a passage 72 therebeneath.

Bridging said spaced walls 70 and 71 is a plate member or top wall 75. Spaced above said top wall 75 is a pipe member 76 having a plurality of tee fittings 77, namely, as here shown, fittings 77*b–d* and end couplings 77*a* and 77*f*. Said pipe member 76 with its related fittings forms a manifold.

The fluid line 16 has a tee fitting 80 adjacent the forward portion of the hood 22 which provides two branch lines 16*a* and 16*b*, said lines running to the fittings 77*a* and 77*d*.

The tee fittings 77*e, b, c* and *f* carry small jets 82*a–d* which extend through the top wall 75 and the same are positioned and spaced to provide a spray fully across said passage 73, said jets being arranged to have their spray patterns overlap and to produce a knife edge cutting spray, said spray being rearwardly diverted by the angled lower portion of the wall 70*a* as indicated by the arrow A in FIG. 7.

Adjacent said jets in said top wall 75 are elongated air ports 90 of a particular length through which a sized stream of air is drawn and entrained into the cleaning fluid emerging from said jets, said air stream being indicated by the arrows B. Said air stream and said cleaning fluid from said jets are coextensive the length of the passage 73. The cleaning fluid is under pressure—which may be on the order of 600 P.S.I.—and has a very positive draw or suction upon the air coming through the ports 90.

The cleaning fluid from the jets 77*a, b, c* and *f* with the air stream from the air slots 90 entrained therein causes the fluid to be reduced to very fine particles to have a fine leading edge which becomes a very effective cleaning edge.

The suction upon the passage 30 is constant subject to adjustment and is independent of the application of the cleaning fluid. The suction through said passage 30 in drawing upon said stream A of cleaning fluid and said air stream B aids in causing a very complete co-mixture thereof and draws said fluid and air streams in a continuous motion through said passage 72 and over the surface 100 being cleaned. The reactive force of the jets tends to lift the nozzle structure to provide an easy gliding effect in its operation.

Just prior to engagement of the stream of mixed air and cleaning fluid through the passage 73 with the underlying surface, another important element is brought into the described cleaning operation.

Although the leading edge of the nozzle structure would tend to permit the entry of air, it has been found useful to allow the entry of air under the forward edge portion 70*a* of the wall 70.

Thus spaced across the bottom edge 70*c* of the front wall 70 are a plurality of open bottom vents 70*d* here shown to be as an inverted V in form as illustrated in FIG. 4.

Said vents 70*d* are positioned to be in alignment with the overlap of sprayed fluid from said jets 82 *a–d* as above described. The action of the suction through the passages 73 and 30 in drawing upon the stream of air and fluid mixture therein in effect creates a venturi at the edge 70*a* just at its engagement with the underlying surface. The passage of air through said vents 70*d* is drawn through the nap or pile of the underlying surface into confluence with the stream of air B and fluid A moving down the passage 73.

The incoming air through said vents enters under said edge 70*a* with such considerable force as to cause said stream A to diverge from its substantially vertical path into a substantially shallow angled path, as indicated by the arrows in FIG. 7, in passing under the edge 71*a*. It will be noted that the streams of air and cleaning fluid pass through what is shown as the pile 100.

Said chambers of passages 30 and 73 at their lower end portions have common end walls 38 and 39. Said end wall 39 and its related structure shall be described and shall be representative of said wall 38 and its related structure and which shall be indicated by like reference numerals with a prime added.

Figure 10:
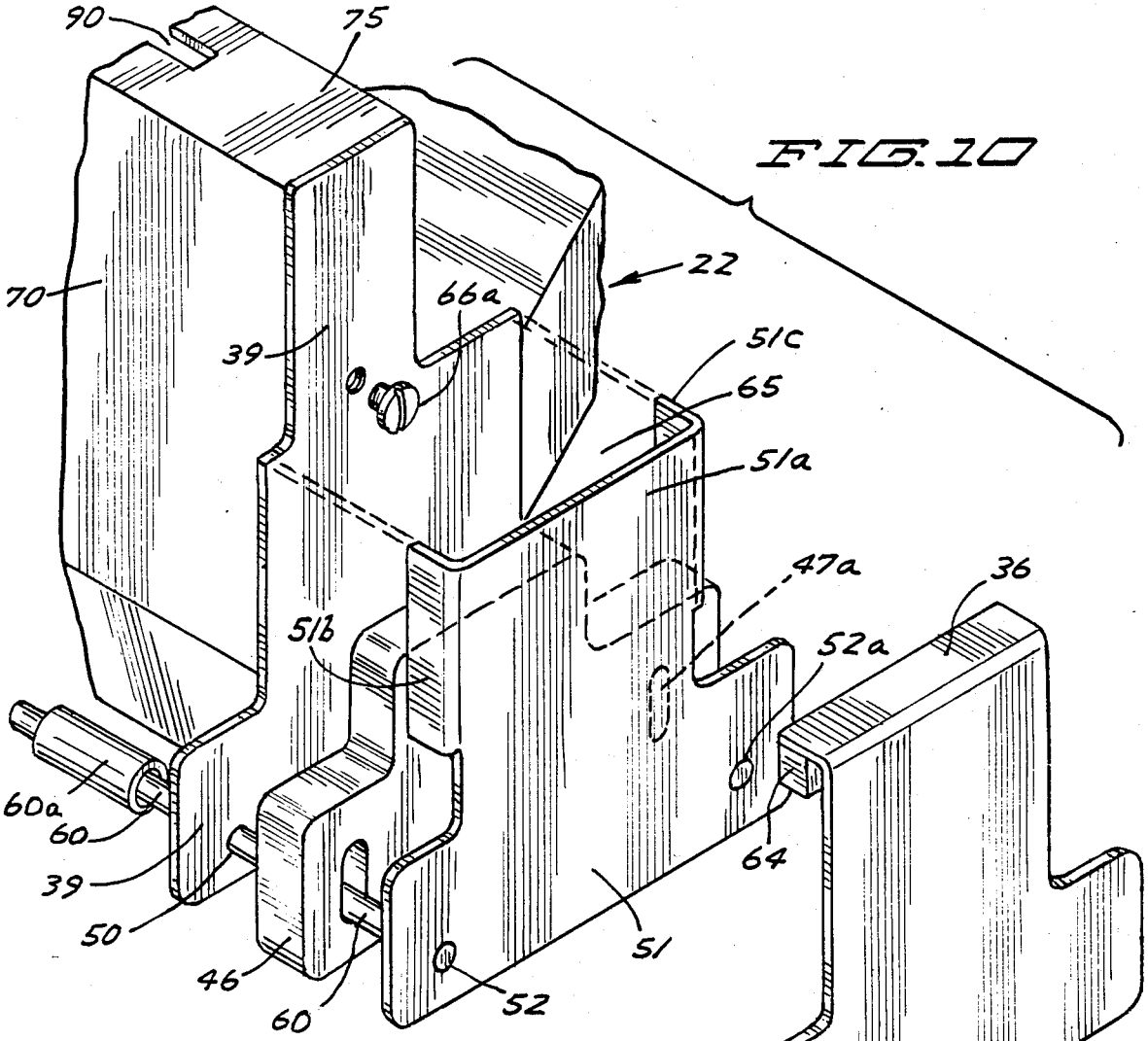
FIG. 10 is an exploded view of a detail of structure on an enlarged scale.
Figure 11:
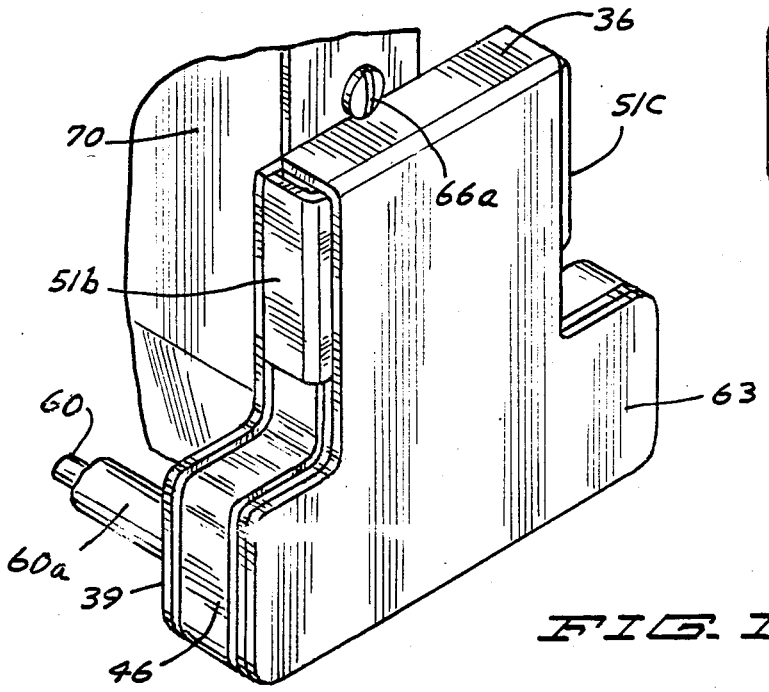
FIG. 11 is a view similar to that of FIG. 10 in assembled condition.
Figure 12:
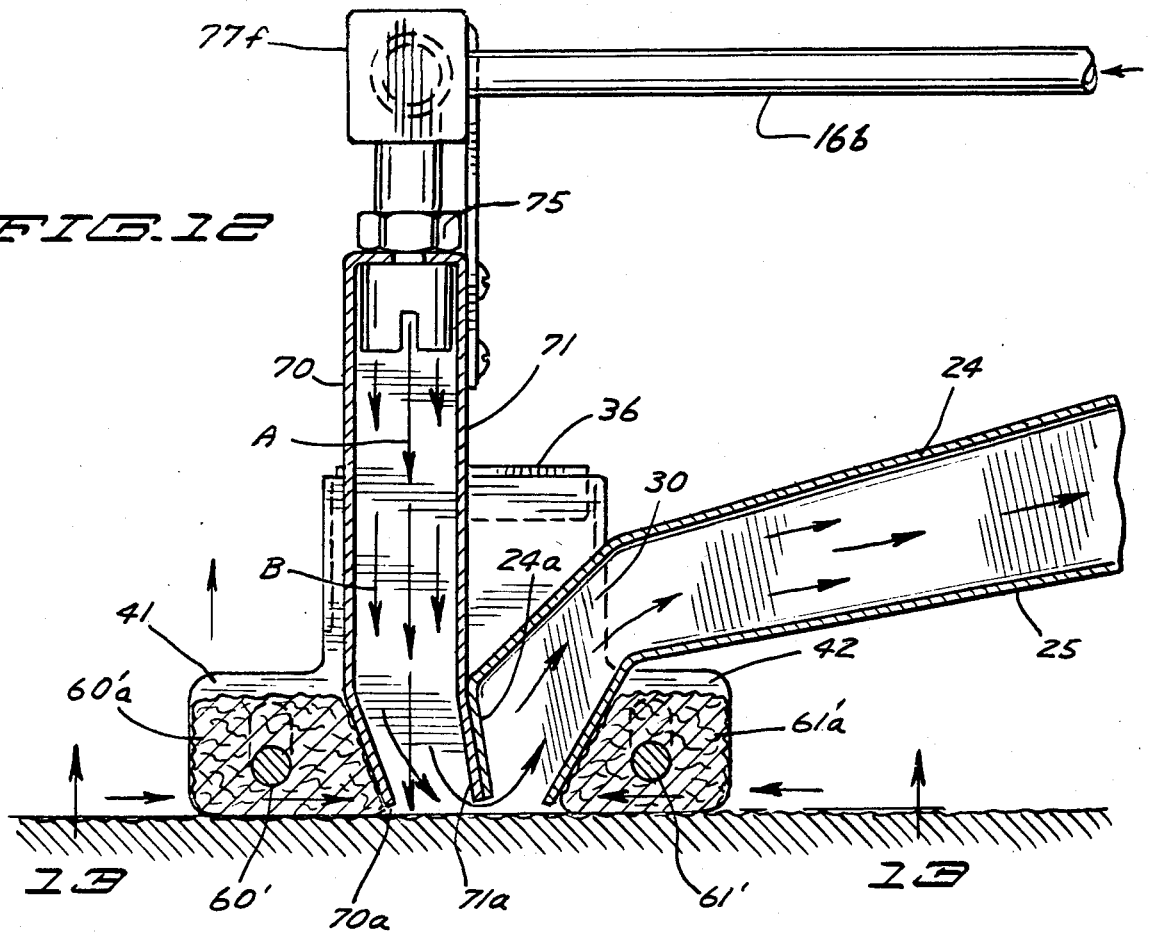
FIG. 12 is a view in vertical longitudinal section similar to that of FIG. 7 but showing a modification.

Said end wall 39 and its related structure is shown in an enlarged exploded view in FIG. 10 and in an enlarged assembled view in FIG. 11.

Said wall 39 is of an inverted T shape in form having its lower portions 39*a* and 39*b* extending forwardly and rearwardly of said passages 73 and 30 and provide stable support to said cleaning head structure.

Said end wall 39 has a pair of transversely spaced apertures 50 and 50*a* extending through the portions 39*a* and 39*b*.

Spaced outwardly of said end wall 39 is a like wall 51 of a shorter height and having extending outwardly as shown, of its upper portion 51*a* a pair of ears 51*b* and 51*c* which are angled rearwardly and are secured to said wall 39 as by welding. A space or passage 65 is formed between said walls 39 and 51. Said wall 51 has a pair of transverse apertures 52 and 52*a* aligned with said apertures 50 and 50*a*.

Disposed between said walls 39 and 51 is a floating plate or shoe member 46 having the same form in plan as said wall 39 but being of a lesser height. Said shoe member 46 has a pair of vertically elongated slots 47 and 47*a* in register with said slots 50 and 50*a*. Thus said shoe member 46 has free vertical movement adjusting itself to a sealing engagement with the underlying surface. Said shoe will have sufficient weight for this purpose.

The floating shoes 45 and 46 are very effective in sealing the ends of said cleaning head from entry of air. The air streams entering through the ports 90 and through the vents 70*d* follow well controlled paths for effective performance and results.

Overlying the outer side of said wall member 51 is a cover plate 63 having a like configuration in plan as said wall 51 and having further as upper reversely angled portion forming a hook 36 having a depending portion 64 which is disposed into the space 65.

A retaining screw 66*a* is threaded into the wall 39 just above the top wall of said hook 36 and projects outwardly partially thereover to prevent dislodgment of the outer end cover plate member 63.

An air stream is drawn inwardly through said vents 70*d* with considerable force so long as the passages 73 and 30 are under the influence of suction. At such times as the cleaning fluid is not fed through the jets 77*a, b, c* and *f*, the air stream through said vents is drawn over and through the cleaned area withdrawing substantial moisture from the cleaned area leaving only a minimum residue of dampness.

Passing through said apertures 50 and 50*a* of said end wall 39, through the slots 47 and 47*a* of said shoe 46 and through the apertures 52 and 52*a* of said wall 51 are rods 61 and 62. Axial movement of said rods is blocked by the end cover plate 63 and its corresponding other end plate 63'.

Said rods 60 and 61 for their extent between the end wall 38 and 39 respectively have rollers 60*a* and 61*a* disposed thereover and the function thereof will be hereinafter described.

Said rollers 60*a* and 61*a* are positioned to engage the nap or pile of an underlying carpeted surface and align said nap or pile to be uniform in the wake of the cleaning action of the cleaning head leaving no ruffled disturbed appearing surface as a result of the action of the high pressure streams of cleaning fluid emitted by the jets as described. Said rollers also provide said head with a stable underlying support and base. The air entering through said vents 70*d* tends to have significant impact on the overlap of the jet streams of cleaning fluid causing such an effective dispersion of the fluid that there is a substantial reduction of excess fluid in the nap or pile at these areas.

MODIFICATION

Figure 13:
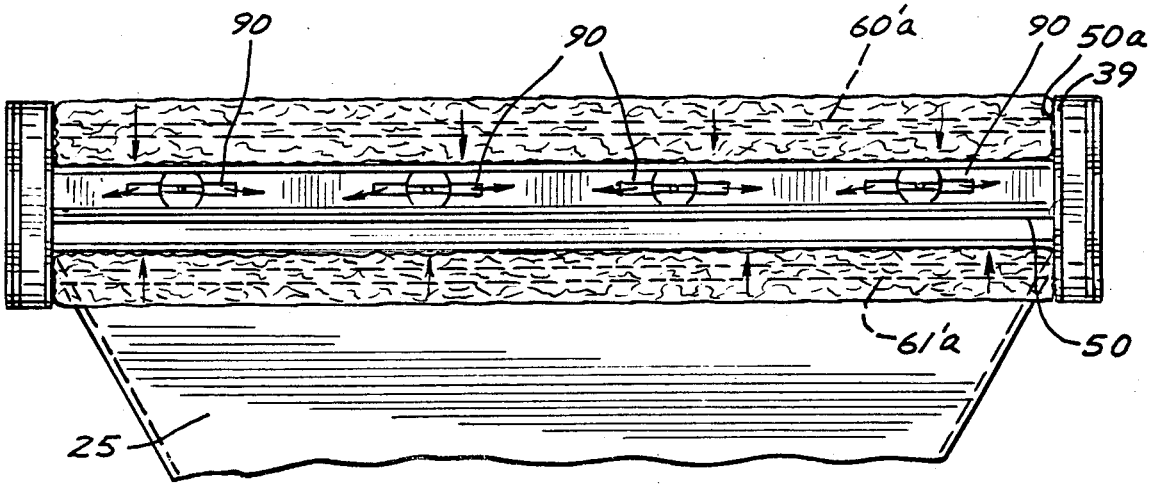
FIG. 13 is a fragmentary bottom plan view taken on line 13—13 of FIG. 12 as indicated.

Referring to FIGS. 11 and 13, a modification is shown. Like reference numerals are used to indicate elements above described and a prime is added to show a modification of a part previously described.

The structure of FIGS. 11 and 13 is intended for use on hard surfaces, hard surface covering materials or surface material having no raised portion such as a pile or a nap. On such materials some scrubbing action is helpful in securing desired results.

The rods 60 and 61 shown here as rods 60' and 61' form the cores of elongated cleaning elements 60'*a* and 61'*a*, said elements being here shown as scrubbing pads. Said pads will have a bottom surface portion suitable for cleaning purposes and will be sufficiently porous for the passage of air therethrough.

In other respects, the modified structure operates and performs as the structure first above described.

The structures herein described have been very successfully commercially tested, have performed impressively and have been well received in the marketplace.

It will of course be understood that various changes may be made in form, details, arrangement and proportions of the product without departing from the scope of the invention which, generally stated, consists in a product capable of carrying out the objects above set forth, such as disclosed and defined in the appended claims.

What is claimed is:

1. In connection with a surface cleaning apparatus, a cleaning head structure comprising a hood having a chamber therein, said hood tapering at one end, a tubular member extending from said tapered end of said hood and communicating with a source of suction, said hood diverging in width at its other end, a housing extending across said other end of said hood, a manifold comprising a plurality of jets, said housing supporting said manifold, said jets extending into said housing spaced thereacross, means supplying said jets with cleaning fluid, said hood forming a passage into and adjacent the bottom of said housing, a passage in said housing extending to adjacent the bottom thereof defining a path for cleaning fluid from said jets, said first and second mentioned passages having adjoining walls above the bottom plane of said housing forming a passage therebeneath, a plurality of air ports adjacent said jets into said housing providing an air stream co-mixing with the cleaning fluid from said jets, means providing a second stream of air into said housing, said suction drawing upon said tubular member and said passages forming a low pressure area at the base of said first and second mentioned passages, causing a venturi effect to draw said second stream of air into confluence with said co-mixed air and cleaning fluid stream in said second mentioned passage at the bottom of said second passage, and whereby said confluent streams are drawn through the surface being cleaned in a continuous motion leaving only a residue of dampness.

2. The structure of claim 1, including a floating shoe forming an end wall at each end of said housing having sealing engagement with its underlying surface.

3. The structure of claim 1, including at least one rod extending across said housing adjacent the bottom plane thereof, said rod being adapted to engage the underlying surface to smooth the surface portion thereof.

4. The structure of claim 1, including said housing having end walls projecting forwardly and rearwardly of said housing, a transverse rod adjacent extending between said end walls, the bottom plane of said housing, and a roller co-extensive with said rod carried thereby for engagement with the underlying surface.

5. The structure of claim 1, wherein said last mentioned means comprising vents in the leading bottom edge of said housing.

6. The structure of claim 1, wherein the bottom front edge of said housing has spaced vents therein, said jets emit streams of cleaning fluid which have overlap areas, and said vents are adapted and arranged to be in alignment with said overlap areas to cause a dispersion of the same.

7. The structure of claim 1, including a pair of spaced apart walls at each end of said housing, a rod extending across said housing and through said walls, a floating shoe being disposed between each of said respective pairs of walls, each of said shoes having a vertically elongated slot to receive said rod therethrough, a cover plate removably attached to the outer of said pairs of walls at each outer end of said housing preventing outward movement of said rod.

8. The structure of claim 7, including a cleaning element mounted upon said rod for engagement with the underlying surface.

9. The structure of claim 1, including a pair of spaced apart walls at each end of said housing, a pair of rods extending across said housing and through said walls, a floating shoe being disposed between each of said respective pairs of walls, each of said shoes having a vertically elongated slot to receive said rods therethrough, a cover plate removably attached to the outer of said pairs of walls at each outer end of said housing preventing outward movement of said rods.

* * * * *